US005707942A

United States Patent [19]

Arai et al.

[11] Patent Number: 5,707,942

[45] Date of Patent: Jan. 13, 1998

[54] LUBRICATING OIL COMPOSITION

[75] Inventors: Katsuya Arai; Satoshi Asano; Shigeyuki Yoshizawa, all of Ohi-machi; Kenyu Akiyama, Toyota; Takashi Kikuchi, Nagoya, all of Japan

[73] Assignees: Tonen Corporation, Tokyo; Toyota Jidosha Kabushiki Kaisha, Toyota, both of Japan

[21] Appl. No.: 680,162

[22] Filed: Jul. 15, 1996

[30] Foreign Application Priority Data

Jul. 20, 1995 [JP] Japan ..... 7-206454

[51] Int. Cl.[6] ..... C10M 141/08

[52] U.S. Cl. ..... 508/365; 508/379

[58] Field of Search ..... 508/365, 379

[56] References Cited

U.S. PATENT DOCUMENTS

| | | | |
|---|---|---|---|
| 4,164,473 | 8/1979 | Coupland et al. | 508/365 |
| 4,529,526 | 7/1985 | Inoue et al. | 508/365 |
| 4,647,388 | 3/1987 | Schreiber | 508/365 |
| 4,692,256 | 9/1987 | Amenura et al. | 508/365 |
| 4,786,423 | 11/1988 | Schroeder | 508/365 |
| 4,832,867 | 5/1989 | Seiki et al. | 508/365 |

FOREIGN PATENT DOCUMENTS 882295 11/1961 United Kingdom .

*Primary Examiner*—Jacqueline V. Howard

*Attorney, Agent, or Firm*—Frishauf, Holtz, Goodman, Langer & Chick, P.C.

[57] ABSTRACT

A lubricating oil composition comprising a lubricating base oil, an amine salt of molybdic acid, and a molybdenmn dithiocarbamate and/or a molybdenum dithiophosphate, wherein the content of molybdenum derived from the amine salt of molybdic acid is 200 ppm by weight or more, the content of molybdenum derived from the molybdenum dithiocarbamate and/or the molybdenum dithiophosphate is 200 to 700 ppm by weight, and the total content of molybdemum is 400 ppm by weight or more. The lubricating oil composition can maintain the effect to decrease friction in engines for a long time without being affected by nitrogen oxide gases.

19 Claims, No Drawings

LUBRICATING OIL COMPOSITION

FIELD OF THE INVENTION

The present invention relates to a novel lubricating oil composition. More particularly, the present invention relates to a lubricating oil composition which exhibits excellent low abrasion and low friction properties, is not deteriorated under an atmosphere of an air containing nitrogen oxides, can maintain the low friction property for a long time, and can be advantageously used as a lubricating oil for internal combustion engines, automatic transmissions, shock absorbers, and power steering systems, particularly as a lubricating oil for internal combustion engines.

PRIOR ART OF THE INVENTION

In combustion engines, driving mechanisms such as automatic transmissions, shock absorbers, and power steering systems, and gears, lubricating oils are used for smoothing their movements. Particularly, lubricating oils for internal combustion engines have the function of lubrication in various sliding parts, such as lubrication between piston rings and cylinder liners, lubrication in bearings of crank shafts or connecting rods, and lubrication in moving valve mechanisms including cams and valve lifters, as well as the functions of cooling engines, cleaning and dispersing combustion products, and preventing formation of rust and corrosion.

A variety of function are required for lubricating oils for internal engines as described above. Lubricating properties of still higher levels are required as internal engines recently tend to show higher performances, such as lower fuel consumption, higher output power, and severer conditions of driving. On the other hand, a part of the combustion gas in internal engines leaks into the crank case through the gap between pistons and cylinders. In the combustion gas, nitrogen oxide gases are contained in a considerably high concentration. These gases degrade lubricating oils in internal engines in combination with oxygen in the blowby gas. With the recent tendency to higher performances of internal engines, the concentration of nitrogen oxide gases leaking into the crank case tends to increase. Therefore, in order to satisfy the above requirements and to prevent the degradation of lubricating oils in internal engines under an atmosphere of an air containing nitrogen oxides, various additives, such as antiwear agents, metallic detergents, ashless dispersants, and antioxidants, are mixed with lubricating oils for internal engines.

It is particularly important as the basic function of a lubricating oil for internal engines that the lubricating oil can make the mechanisms move smoothly under any conditions and can prevent abrasion and seizure. Most of the lubricating parts are in a fluid lubricated condition. However, the upper and lower dead portions in moving valve systems and pistons tend to be in the critical lubricating condition. The property to prevent abrasion in the critical lubricating condition is generally provided to lubricating oils by addition of zinc dithiophosphate.

In internal engines, because friction parts to which lubricating oils are related cause a large energy loss, friction modifiers are added to lubricating oils as a method to decrease friction loss and fuel consumption. As the friction modifier, for example, organic molybdenum compounds, esters of fatty acids, and alkylamines are generally used. However, though these friction modifiers exhibit the expected effect in the initial period of the application, the effect is lost by oxidative degradation with oxygen in the air.

The loss of the effect is particularly significant in the presence of nitrogen oxide gases. Moreover, some friction modifiers such as molybdenum dithiocarbamate have low solubilities in lubricating base oils and form precipitates after storage at low temperatures for a long time. Therefore, the amount of the addition is naturally limited.

SUMMARY OF THE INVENTION

Accordingly, the present invention has the object of providing a lubricating oil composition which is not affected by nitrogen oxide gases and can maintain the effect to decrease friction in engines for a long time.

As the result of extensive studies by the present inventors, it was discovered that the above object can be achieved by a lubricating oil composition comprising a lubricating base oil, a specific amount of a secondary amine salt of molybdic acid having a specific structure, and specific amounts of a molybdenum dithiocarbamate having a specific structure and/or a molybdenum dithiophosphate having a specific structure. The present invention has been completed on the basis of the discovery.

Thus, the present invention provides (1) a lubricating oil composition comprising a lubricating base oil, (A) an amine salt of molybdic acid represented by the general formula [1]:

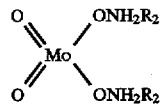

[1]

(wherein R represents a hydrocarbon group having 6 to 15 carbon atoms), and (B) a molybdenum dithiocarbamate represented by the general formula [2]:

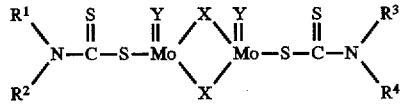

[2]

(wherein $R^1$, $R^2$, $R^3$, and $R^4$ represent each a hydrocarbon group having 6 to 15 carbon atoms, and X and Y represent each S or O) and/or a molybdenum dithiophosphate represented by the general formula [3]:

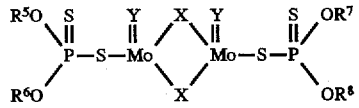

[3]

(wherein $R^5$, $R^6$, $R^7$, and $R^8$ represent each a hydrocarbon group having 6 to 15 carbon atoms, and X and Y represent each S or O), wherein the content of molybdenum derived from the amine salt of molybdic acid is 200 ppm by weight or more, the content of molybdenum derived from the molybdenum dithiocarbamate and/or the molybdenum dithiophosphate is 200 to 700 ppm by weight, and the total content of molybdenum is 400 ppm by weight or more.

Preferable embodiments of the present invention include: (2) a lubricating oil composition comprising a lubricating base oil, (A) an amine salt of molybdic add represented by the general formula [1]:

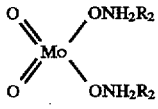

[1]

(wherein R represents a hydrocarbon group having 6 to 15 carbon atoms), and (B) a molybdenum dithiocarbamate represented by the general formula [2]:

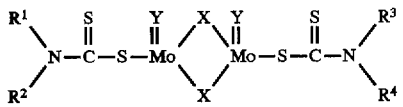

[2]

(wherein $R^1$, $R^2$, $R^3$, and $R^4$ represent each a hydrocarbon group having 6 to 15 carbon atoms, and X and Y represent each S or O) and/or a molybdenum dithiophosphate represented by the general formula [3]:

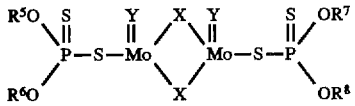

[3]

(wherein $R^5$, $R^6$, $R^7$, and $R^8$ represent each a hydrocarbon group having 6 to 15 carbon atoms, and X and Y represent each S or O), wherein the content of molybdenum derived from the amine salt of molybdic acid is 200 to 2,500 ppm by weight, the content of molybdenum derived from the molybdenum dithiocarbamate and/or the molybdenum dithiophosphate is 200 to 700 ppm by weight, and the total content of molybdenum is 400 to 3,200 ppm by weight;

(3) a lubricating oil composition comprising a lubricating base oil, (A) an amine salt of molybdic acid represented by the general formula [1]:

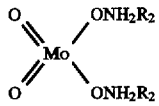

[1]

(wherein R represents a hydrocarbon group having 10 to 13 carbon atoms), and (B) a molybdenum dithiocarbamate represented by the general formula [2]:

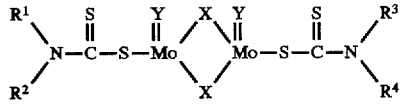

[2]

(wherein $R^1$, $R^2$, $R^3$, and $R^4$ represent each a hydrocarbon group having 8 to 13 carbon atoms, and X and Y represent each S or O) and/or a molybdenum dithiophosphate represented by the general formula [3]:

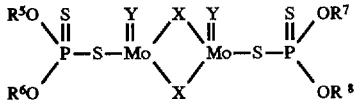

[3]

(wherein $R^5$, $R^6$, $R^7$, and $R^8$ represent each a hydrocarbon group having 8 to 13 carbon atoms, and X and Y represent each S or O), wherein the content of molybdenum derived from the amine salt of molybdic acid is 400 to 2,000 ppm by weight, the content of molybdenum derived from the molybdenum dithiocarbamate and/or the molybdenum dithiophosphate is 200 to 700 ppm by weight, and the total content of molybdenum is 600 to 2,700 ppm by weight;

(4) a lubricating oil composition comprising a lubricating base oil, (A) an amine salt of molybdic acid represented by the general formula [1]:

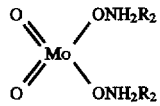

[1]

(wherein R represents a hydrocarbon group having 10 to 13 carbon atoms), and (B) a molybdenum dithiocarbamate represented by the general formula [2]:

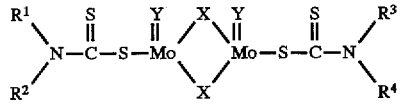

[2]

(wherein $R^1$, $R^2$, $R^3$, and $R^4$ represent each a hydrocarbon group having 8 to 13 carbon atoms, X represents O, and Y represents S) and/or a molybdenum dithiophosphate represented by the general formula [3]:

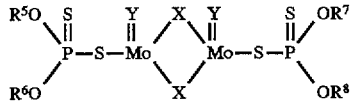

[3]

(wherein $R^5$, $R^6$, $R^7$, and $R^8$ represent each a hydrocarbon group having 8 to 13 carbon atoms, X represents O, and Y represents S), wherein the content of molybdenum derived from the amine salt of molybdic acid is 400 to 2,000 ppm by weight, the content of molybdenum derived from the molybdenum dithiocarbamate and/or the molybdenum dithiophosphate is 200 to 700 ppm by weight, and the total content of molybdenum is 600 to 2,700 ppm by weight; and (5) a lubricating oil composition comprising a lubricating base oil, (A) an amine salt of molybdic add represented by the general formula [1]:

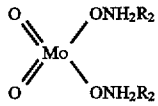

[1]

(wherein R represents a hydrocarbon group having 10 to 13 carbon atoms), and (B) a molybdenum dithiocarbamate represented by the general formula [2]:

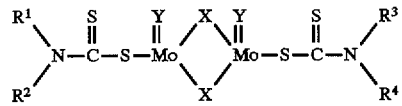

[2]

(wherein $R^1$, $R^2$, $R^3$, and $R^4$ represent each a hydrocarbon group having 8 to 13 carbon atoms, X represents O, and Y represents S), wherein the content of molybdenum derived from the amine salt of molybdic acid is 400 to 2,000 ppm by weight, the content of molybdenum derived from the molybdenum dithiocarbamate is 200 to 700 ppm by weight, and the total content of molybdenum is 600 to 2,700 ppm by weight.

DETAILED DESCRIPTION OF THE INVENTION

The lubricating base oil used in the lubricating oil composition of the present invention is not particularly limited, and oils conventionally used as a lubricating base oil, such as mineral oils and synthetic oils, can be used. Examples of the mineral oil include raffinates obtained by solvent purification of materials of lubricating oil using aromatic extraction solvents such as phenol and furfural, hydrogenated oils obtained by hydrogenation of materials of lubricating oil using hydrogenation catalysts such as cobalt and molybdenum supported on silica-alumina, and lubricating oil fractions obtained by isomerization of wax. Specific examples of the mineral oil include 60 neutral oil, 100 neutral oil, 150 neutral oil, 300 neutral oil, 500 neutral oil, and bright stock.

Examples of the synthetic oil include poly-α-olefin oligomers, polybutenes, alkylbenzenes, polyol esters, polyglycol esters, esters of dibasic acids, esters of phosphoric acid, and silicone oils.

The lubricating base oil may be used singly or as a combination of two or more types.

As the lubricating base oil used in the lubricating oil composition of the present invention, oils having a viscosity in the range of 3 to 20 $mm^2/s$ at 100° C. are preferable. Hydrogenated oils and lubricating oil fractions obtained by isomerization of wax which contain 3% by weight or less of aromatic fractions, 50 ppm or less by weight of sulfur components, and 50 ppm by weight of nitrogen components are particularly preferable.

In the lubricating oil composition of the present invention, an amine salt of molybdic acid represented by the general formula [1]:

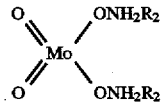

[1]

is comprised.

In the general formula [1], R represents a hydrocarbon group having 6 to 15 carbon atoms. Four hydrocarbon groups in the general formula [1] may be the same with each other or different from each other. Examples of the hydrocarbon group having 6 to 15 carbon atoms include alkyl groups having 6 to 15 carbon atoms, alkenyl groups having 6 to 15 carbon atoms, cycloalkyl groups having 6 to 15 carbon atoms, and aryl groups, alkylaryl groups, and arylalkyl groups having 6 to 15 carbon atoms. Specific examples of the hydrocarbon group having 6 to 15 carbon atoms include hexyl group, heptyl group, octyl group, nonyl group, decyl group, undecyl group, dodecyl group, tridecyl group, tetradecyl group, pentadecyl group, octenyl group, nonenyl group, decenyl group, undecenyl group, dodecyl group, tridecenyl group, tetradecenyl group, pentadecenyl group, dimethylcyclohexyl group, ethylcylohexyl group, methylcyclohexylmethyl group, cyclohexylethyl group, propylcyclohexyl group, butylcyclohexyl group, heptylcyclohexyl group, dimethylphenyl group, methylbenzyl group, phenetyl group, naphthyl group, and dimethylnaphthyl group. When the hydrocarbon group represented by R has less than 6 carbon atoms, there is the possibility that the solubility of the amine salt of molybdic acid in the lubricating base oil decreases. When the hydrocarbon group represented by R has more than 15 carbon atoms, there is the possibility that an excessively large amount of the amine salt of molybdic acid is required.

In the lubricating oil composition of the present invention, the amine salt of molybdic acid represented by the general formula [1] may be used singly or as a combination of two or more types. In the lubricating oil composition of the present invention, the amine salt of molybdic acid represented by the general formula [1] is comprised in such an amount that the content of molybdenum derived from the amine salt of molybdic acid is 200 ppm by weight or more, preferably 200 to 2,500 ppm by weight, more preferably 400 to 2,000 ppm by weight, based on the total weight of the lubricating oil composition. When the amine salt of molybdic acid represented by the general formula [1] is comprised in such an amount that the content of molybdenum derived from the amine salt of molybdic acid is less than 200 ppm by weight based on the total weight of the lubricating oil composition, there is the possibility that the effect of the amine salt of molybdic acid to improve the low friction property is not sufficiently exhibited. When the statue salt of molybdic acid represented by the general formula [1] is comprised in such an amount that the content of molybdenum derived from the amine salt of molybdic acid is more than 2,500 ppm by weight based on the total weight of the lubricating oil composition, there is the possibility that the effect of the amine salt of molybdic acid to improve the low friction property is not exhibited to the degree proportional to the comprised amount.

In the lubricating oil composition of the present invention, a molybdenum dithiocarbamate represented by the general formula [2]and/or a molybdenum dithiophosphate represented by the general formula [3] are comprised.

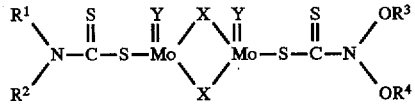

[2]

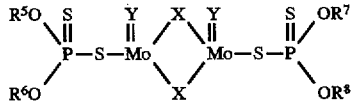

[3]

In the general formula [2], $R^1$, $R^2$, $R^3$, and $R^4$ represent each a hydrocarbon group having 6 to 15 carbon atoms, and X and Y represent each sulfur or oxygen. In the general formula [2], the hydrocarbon groups represented by $R^1$, $R^2$, $R^3$, and $R^4$ may be the same with each other or different from each other. In the general formula [2], all of X and Y may be sulfur or oxygen, or some of X and Y may be sulfur while the remaining X and Y are oxygen. Examples of the hydrocarbon group represented by $R^1$, $R^2$, $R^3$, and $R^4$ include alkyl groups having 6 to 15 carbon atoms, alkenyl groups having 6 to 15 carbon atoms, cycloalkyl groups having 6 to 15 carbon atoms, and aryl groups, alkylaryl groups, and arylalkyl groups having 6 to 15 carbon atoms. Specific examples of the hydrocarbon group having 6 to 15 carbon atoms include hexyl group, heptyl group, octyl group, nonyl group, decyl group, undecyl group, dodecyl group, tridecyl group, octenyl group, nonenyl group, decenyl group, undecenyl group, dodecenyl group, tridecenyl group, tetradecenyl group, pentadecenyl group, dimethylcyclohexyl group, ethylcylohexyl group, methylcyclohexylmethyl group, cyclohexylethyl group, propylcyclohexyl group, butylcyclohexyl group, heptylcyclohexyl group, dimethylphenyl group, methylbenzyl group, phenetyl group, naphthyl group, and dimethylnaphthyl group. When the hydrocarbon groups represented by $R^1$, $R^2$, $R^3$, and $R^4$ have less than 6 carbon atoms, there is the possibility that the solubility of the molybdenum dithiocarbamate in the lubricating base oil decreases. When the hydrocarbon groups represented by $R^1$, $R^2$, $R^3$, and $R^4$ have more than 15 carbon atoms, there is the possibility that an excessively large amount of the molybdenum dithiocarbamate is required.

In the general formula [3], $R^5$, $R^6$, $R^7$, and $R^8$ represent each a hydrocarbon group having 6 to 15 carbon atoms, and X and Y represent each sulfur or oxygen. In the general formula [3], the hydrocarbon groups represented by $R^5$, $R^6$, $R^7$, and $R^8$ may be the same with each other or different from each other. In the general formula [3], all of X and Y may be sulfur or oxygen, or some of X and Y may be sulfur while the remaining X and Y are oxygen. Examples of the hydrocarbon group represented by $R^5$, $R^6$, $R^7$, and $R^8$ include alkyl groups having 6 to 15 carbon atoms, alkenyl groups having 6 to 15 carbon atoms, cycloalkyl groups having 6 to 15 carbon atoms, and aryl groups, alkylaryl groups, and arylalkyl groups having 6 to 15 carbon atoms. Specific examples of the hydrocarbon group having 6 to 15 carbon atoms include hexyl group, heptyl group, octyl group, nonyl group, decyl group, undecyl group, dodecyl group, tridecyl group, octenyl group, nonenyl group, decenyl group, undecenyl group, dodecenyl group, tridecenyl group, tetradecenyl group, pentadecenyl group, dimethylcyclohexyl group, ethylcylohexyl group, methylcyclohexylmethyl group, cyclohexylethyl group, propylcyclohexyl group, butylcyclohexyl group, heptylcyclohexyl group, dimethylphenyl group, methylbenzyl group, phenetyl group, naphthyl group, and dimethylnaphthyl group. When the hydrocarbon groups represented by $R^5$, $R^6$, $R^7$, and $R^8$ have 6 or less carbon atoms, there is the possibility that the solubility of the molybdenum dithiophosphate in the lubricating base oil decreases. When the hydrocarbon groups represented by $R^5$, $R^6$, $R^7$, and $R^8$ have 15 or more carbon atoms, there is the possibility that an excessively large amount of the molybdenum dithiophosphate is required.

In the lubricating oil composition of the present invention, the molybdenum dithiocarbamate represented by the general formula [2] and/or the molybdenum dithiophosphate represented by the general formula [3] may be used singly or as a combination of two or more types. In the lubricating oil composition of the present invention, the molybdenum dithiocarbamate represented by the general formula [2] and/or the molybdenum dithiophosphate represented by the general formula [3] are comprised in such amounts that the content of molybdenum derived from the molybdenum dithiocarbamate represented by the general formula [2] and/or the molybdenum dithiophosphate represented by the general formula [3] is 200 to 700 ppm by weight, preferably 300 to 600 ppm by weight, based on the total weight of the lubricating oil composition. When the molybdenum dithiocarbamate represented by the general formula [2] and/or the molybdenum dithiophosphate represented by the general formula [3] are comprised in such amounts that the content of molybdenum derived from the molybdenum dithiocarbamate and/or the molybdenum dithiophosphate is less than 200 ppm by weight based on the total weight of the lubricating oil composition, there is the possibility that the effect of the molybdenum dithiocarbamate and/or the molybdenum dithiophosphate to improve the low friction property is not sufficiently exhibited, and the low friction property is deteriorated to a great extent by oxidation. When the molybdenum dithiocarbamate represented by the general formula [2] and/or the molybdenum dithiophosphate represented by the general formula [3] are comprised in such amounts that the content of molybdenum derived from the molybdenum dithiocarbamate and/or the molybdenum dithiophosphate is more than 700 ppm by weight based on the total weight of the lubricating oil composition, there is the possibility that precipitates are formed at low temperatures.

In the lubricating oil composition of the present invention, the total content of molybdenum derived from the amine salt of molybdic acid and the molybdenum dithiocarbamate and/or the molybdenum dithiophosphate is 400 ppm by weight or more, preferably 400 to 3,200 ppm by weight, more preferably 600 to 2,700 ppm by weight, based on the total weight of the lubricating oil composition. When the total content of molybdenum base on the total weight of the lubricating oil composition is less than 400 ppm by weight, there is the possibility that the effect of the amine salt of molybdic acid and the molybdenum dithiocarbamate and/or the molybdenum dithiophosphate to improve the low friction property is not sufficiently exhibited. When the total content of molybdenum based on the total weight of the lubricating oil composition is more than 3,200 ppm by weight, there is the possibility that the effect of the amine salt of molybdic acid and the molybdenum dithiocarbamate and/or the molybdenum dithiophosphate to improve the low friction property is not exhibited to the degree proportional to the comprised amount.

In the lubricating oil composition of the present invention, deterioration of the low friction property by oxidation is prevented and the storage stability at low temperatures is remarkably improved by the combined use of the amine salt of molybdic acid and the molybdenum dithiocarbamate and/or the molybdenum dithiophosphate as the friction modifier. Conventional lubricating oil compositions using a molybdenum dithiocarbamate alone as the friction modifier have problems that the effect of the friction modifier to decrease friction is quickly deteriorated by oxidative degradation, and that it is difficult that the lubricating oil composition comprises a sufficient amount of a molybdenum dithiocarbamate because the amount of the molybdenum dithiocarbamate comprised in the lubricating oil composition is limited by the low solubilities of molybdenum dithiocarbamates in the lubrication oil composition and the resultant tendency to cause precipitation at low temperatures. Because the amine salt of molybdic acid and molybdenum dithiocarbamate and or molybdenum dithiophosphate are used in combination, the lubricating oil composition of the present invention enables the increase in the amount of molybdenum which can be comprised in the lubricating oil composition to three times the amount of molybdenum which can be comprised in the lubricating oil composition using molybdenum dithiocarbamate alone, and the effect of the lubricating oil composition to decrease friction can remarkably be increased.

To the lubricating oil composition of the present invention, various additives which have conventionally been used in lubricating oils, such as other friction modifiers, metallic detergents, antiwear agents, ashless dispersants, antioxidants, viscosity index improvers, pour point depressants, defoaming agents, rust-preventives, and corrosion inhibitors, can be added within the range that the object of the present invention is not adversely affected.

Examples of the other friction modifiers include partial esters of polyhydric alcohols, amines, amides, and sulfides of esters.

Examples of the metallic detergent include calcium salicylates, magnesium salicylates, calcium sulfonates, magnesium sulfonates, barium sulfonates, calcium phenates, and barium phenates. The metallic detergent is generally comprised in an amount of 0.1 to 5% by weight.

Examples of the antiwear agent include metal salts of thiophosphoric acid, sulfur compounds, esters of phosphoric acid, and esters of phosphorous acid. The antiwear agent is generally comprised in an amount of 0.05 to 5.0% weight.

Examples of the ashless dispersant include succinimide ashless dispersants, succinimide ashless dispersants, benzylamine ashless dispersants, and ester ashless dispersants. The ashless dispersant is generally comprised in an amount of 0.5 to 7% by weight.

Examples of the antioxidant include amine antioxidants, such as alkylated diphenylamines, phenyl-α-naphthylamine, and alkylated α-naphthylamines, and phenolic antioxidants, such as 2,6-di-t-butyl-4-methylphenol and 4,4'-methylenebis(2,6-di-t-butylphenol). Among these antioxidants, phenolic antioxidants are preferable. The antioxidant is generally comprised in an amount of 0.05 to 4% by weight.

Examples of the viscosity index improver include polymethacrylate viscosity index improvers, polyisobutylene viscosity index improvers, ethylene-propylene copolymer viscosity index improvers, and hydrogenated styrene-butadiene copolymer viscosity index improvers. The viscosity index improver is generally comprised in an amount of 0.5 to 35% by weight.

Examples of the pour point depressant include polyalkyl methacrylates, chlorinated paraffin-naphthalene condensates, and alkylated polystyrenes.

Examples of the defoaming agent include dimethylpolysiloxane and polyacrylic acid.

Examples of the rust-preventive include fatty acids, partial esters of alkenylsuccinic acids, fatty acid soaps, salts of alkylsulfonic acids, polyhydric alcohol esters of fatty acids, amines of fatty acids, oxidized paraffins, and alkyl polyoxyethylene ethers.

Examples of the corrosion inhibitor include benzotriazole, thiadiazole, and benzimidazole.

To summarize the advantages of the present invention, because the lubricating oil composition of the present invention comprises a base oil, specific amounts of an amine salt of molybdic acid, and molybdenum dithiocarbamate and/or molybdenum dithiophosphate, the lubricating oil composition has a superior storage stability at low temperatures and very excellent abrasion resistance, and maintains excellent friction characteristics (low friction) because of the superior oxidation resistance even at high temperatures in the presence of nitrogen oxide gases. Thus, the lubricating oil composition can advantageously be used as a lubricating oil for internal combustion engines, automatic transmissions, shock absorbers and power steerings, particularly as a lubricating oil for internal combustion engines.

The present invention is described in more detail with reference to examples in the following. However, the present invention is not limited by the examples.

The amine salts of molybdic acid used in the examples were the compounds represented by the following general formula [1]. The molybdenum dithiocarbamates used in the examples were the compounds represented by the following general formula [4]. The molybdenum dithiophosphate used in the examples was the compound represented by the following general formula [5].

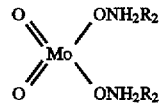

[1]

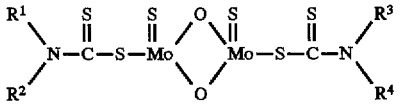

[4]

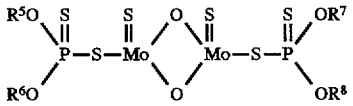

[5]

The friction coefficient of a lubricating oil composition was measured by using a sliding reciprocal vibration friction tester [an SRV friction tester] under the conditions of a frequency of 50 Hz, an amplitude of 3 mm, a load of 25N, a temperature of 80° C., and a test time of 25 minutes.

The oxidation test by an air containing nitrogen oxide gases was conducted by using 150 ml of a test oil under the conditions of a temperature of 130° C., a concentration of nitrogen oxides ($NO_x$) of 1% by volume, a flow rate of the air of 2 liter/hour, and a test time of 8 hours.

The formation of precipitates was evaluated by visual observation. A lubricating oil composition in an amount of 500 ml was placed in a glass vessel. The glass vessel was tightly sealed and left standing in a low temperature vessel kept at a constant temperature of −10° C. for 24 hours. The condition of the resultant lubricating off was visually observed.

EXAMPLE 1

To a paraffinic mineral oil having a viscosity of 4.0 $mm^2/s$ at 100° C., 2.0% by weight of a calcium sulfonate as the metallic detergent, 5.0% by weight of succinimide as the ashless dispersant, 1.0% by weight of a hindered phenol as the antioxidant, 1.0% by weight of zinc dithiophosphate as the antiwear agent, 5.0% by weight of a polyalkyl methacrylate as the viscosity index improver, diffidecylamine salt of molybdic acid in such an amount that the content of molybdenum was 1,000 ppm by weight, and molybdenum oxy-sulfide N,N-dioctyldithiocarbamate in such an amount that the content of molybdenmn was 500 ppm by weight were added to prepare a lubricating oil composition.

The prepared lubricating oil composition showed a friction coefficient of 0.09 immediately after the preparation and a friction coefficient of 0.10 after the oxidation test. Formation of precipitates was not observed.

EXAMPLE 2

A lubricating oil composition was prepared in accordance with the same formulation as that in Example 1 except that, as the molybdenum compounds, ditridecylamine salt of molybdic acid was used in such an amount that the content of molybdenum was 1,000 ppm by weight, and molybdenum oxy-sulfide N,N-ditridecyldithiocarbamate was used in such an amount that the content of molybdenum was 500 ppm by weight.

The prepared lubricating oil composition showed a friction coefficient of 0.10 immediately after the preparation and a friction coefficient of 0.12 after the oxidation test. Formation of precipitates was not observed.

EXAMPLE 3

A lubricating oil composition was prepared in accordance with the same formulation as that in Example 1 except that, as the molybdenum compounds, didecylamine salt of molybdic acid was used in such an amount that the content of molybdenum was 1,000 ppm by weight, and molybdenum oxy-sulfide N,N-ditridecyldithiocarbamate was used in such an amount that the content of molybdenum was 500 ppm by weight.

The prepared lubricating oil composition showed a friction coefficient of 0.10 immediately after the preparation and a friction coefficient of 0.12 after the oxidation test. Formation of precipitates was not observed.

EXAMPLE 4 to 8

Lubricating oil compositions were prepared in accordance with the same formulation as that in Example 1 except that the amine salts of molybdic acid and the molybdenum dithiocarbamates shown in Table 1 were used as the molybdenum compounds in such amounts that molybdenmn was contained in amounts shown in Table 1.

The friction coefficients of the prepared lubricating oil compositions immediately after the preparation and after the oxidation test and the results of the observation on the formation of precipitates are shown in Table 1.

EXAMPLE 9

To a poly-α-olefin having a viscosity of 4.0 $mm^2/s$ at 100° C., 2.0% by weight of a calcium sulfonate as the metallic detergent, 5.0% by weight of succinimide as the ashless dispersant, 1.0% by weight of a hindered phenol as the antioxidant, 1.0% by weight of zinc dithiophosphate as the antiwear agent, 5.0% by weight of a polyalkyl methacrylate as the viscosity index improver, ditridecylamine salt of molybdic acid in such an amount that the content of molybdenum was 500 ppm by weight, and molybdenum oxysulfide N,N-dioctyldithiocarbamate in such an amount that the content of molybdenum was 500 ppm by weight were added to prepare a lubricating oil composition.

The prepared lubricating oil composition showed a friction coefficient of 0.10 immediately after the preparation and a friction coefficient of 0.11 after the oxidation test. Formation of precipitates was not observed.

EXAMPLE 10

A lubricating oil composition was prepared in accordance with the same formulation as that in Example 1 except that the amine salt of molybdic acid and the molybdenum dithiophosphate shown in Table 1 were used as the molybdenum compounds in such amounts that molybdenum was contained in amounts shown in Table 1.

The friction coefficients of the prepared lubricating oil composition immediately after the preparation and after the oxidation test and the results of observation on the formation of precipitates are shown in Table 1.

The formulations and the results of the evaluation in Examples 1 to 10 are shown together in Table 1.

TABLE 1-1

| Example | 1 | 2 | 3 | 4 | 5 |
|---|---|---|---|---|---|
| base oil | mineral oil | mineral oil | mineral oil | mineral oil | mineral oil |
| metallic detergent (% by wt.) calcium sulfonate | 2.0 | 2.0 | 2.0 | 2.0 | 2.0 |
| ashless dispersant (% by wt.) succinimide | 5.0 | 5.0 | 5.0 | 5.0 | 5.0 |
| antioxidant (% by weight) hindered phenol | 1.0 | 1.0 | 1.0 | 1.0 | 1.0 |
| antiwear agent (% by wt.) zinc dithiophosphate | 1.0 | 1.0 | 1.0 | 1.0 | 1.0 |
| viscosity index improver (% by wt.) polyalkyl methacrylate | 5.0 | 5.0 | 5.0 | 5.0 | 5.0 |
| Mo derived from amine salt of molybdic acid (ppm) R = tridecyl group | 1,000 | 1,000 | — | — | 400 |
| Mo derived from amine salt of molybdic acid (ppm) R = decyl group | — | — | 1,000 | 1,000 | — |
| Mo derived from molybdenum dithiocarbamate (ppm) $R^1$~$R^4$ = octyl group | 500 | — | — | 500 | 300 |
| Mo derived from molybdenum dithiocarbamate (ppm) $R^1$~$R^4$ = tridecyl group | — | 500 | 500 | — | — |
| Mo derived from molybdenum dithiophosphate (ppm) $R^5$~$R^8$ = octyl group | — | — | — | — | — |
| friction coefficient of fresh oil | 0.09 | 0.10 | 0.10 | 0.09 | 0.11 |
| friction coefficient after oxidation test | 0.10 | 0.12 | 0.12 | 0.10 | 0.13 |
| formation of precipitates | none | none | none | none | none |

TABLE 1-2

| Example | 6 | 7 | 8 | 9 | 10 |
|---|---|---|---|---|---|
| base oil | mineral oil | mineral oil | mineral oil | synthetic oil | mineral oil |
| metallic detergent (% by wt.) calcium sulfonate | 2.0 | 2.0 | 2.0 | 2.0 | 2.0 |
| ashless dispersant (% by wt.) succinimide | 5.0 | 5.0 | 5.0 | 5.0 | 5.0 |
| antioxidant (% by weight) hindered phenol | 1.0 | 1.0 | 1.0 | 1.0 | 1.0 |
| antiwear agent (% by wt.) zinc dithiophosphate | 1.0 | 1.0 | 1.0 | 1.0 | 1.0 |
| viscosity index improver (% by wt.) polyalkyl methacrylate | 5.0 | 5.0 | 5.0 | 5.0 | 5.0 |
| Mo derived from amine salt of molybdic acid (ppm) R = tridecyl group | 2,000 | 1,000 | 1,000 | 500 | 1,000 |
| Mo derived from amine salt of molybdic acid (ppm) R = decyl group | — | — | — | — | — |
| Mo derived from molybdenum dithiocarbamate (ppm) | 500 | 200 | — | 500 | — |

TABLE 1-1-continued

| | | | | | |
|---|---|---|---|---|---|
| R1~R4 = octyl group | | | | | |
| Mo derived from in molybdenum dithiocarbamate (ppm) | — | — | 200 | — | — |
| $R^1$~$R^4$ = tridecyl group | | | | | |
| Mo derived from molybdenum dithiophosphate (ppm) | — | — | — | — | 200 |
| $R^5$~$R^8$ = octyl group | | | | | |
| friction coefficient of fresh oil | 0.08 | 0.10 | 0.11 | 0.10 | 0.10 |
| friction coefficient after oxidation test | 0.08 | 0.13 | 0.13 | 0.11 | 0.13 |
| formation of precipitates | none | none | none | none | none |

The lubricating oil compositions of the present invention shown in Table 1 had all excellent friction characteristics with small friction coefficients immediately after the preparation and showed little change in the fiction coefficients after the oxidation by heating at 130° C. for 8 hours in the presence of nitrogen oxide gases. These results show that these lubricating oil compositions had excellent oxidation resistance. Moreover, formation of precipitates was not observed at all after the lubricating oil compositions were left standing at −10° C. for 24 hours, and the lubricating oil compositions were shown to have excellent storage stability.

COMPARATIVE EXAMPLE 1

A lubricating oil composition was prepared in accordance with the same formulation as that in Example 1 except that ditridecylamine salt of molybdic acid alone was used as the molybdenum compound in such an amount that the content of molybdenum was 1,000 ppm by weight.

The prepared lubricating oil composition showed a friction coefficient of 0.18 immediately after the preparation and a friction coefficient of 0.20 after the oxidation test. Formation of precipitates was not observed.

COMPARATIVE EXAMPLE 2 TO 5

Lubricating oil compositions were prepared in accordance with the same formulation as that in Example 1 except that the amine salts of molybdic acid and the molybdenum dithiocarbamates shown in Table 2 were used as the molybdenum compounds in such amounts that molybdenum was contained in amounts shown in Table 2.

The friction coefficients of the prepared lubricating oil compositions immediately after the preparation and after the oxidation test and the results of observation on the formation of precipitates are shown in Table 2.

COMPARATIVE EXAMPLE 6

A lubricating oil composition was prepared in accordance with the same formulation as that in Example 1 except that 1% by weight of glycerol ester of a fatty acid was used in place of the molybdenum compounds.

The prepared lubricating oil composition showed a friction coefficient of 0.20 immediately after the preparation and a friction coefficient of 0.20 after the oxidation test. Formation of precipitates was not observed.

COMPARATIVE EXAMPLE 7

A lubricating off composition was prepared in accordance with the same formulation as that in Example 1 except that, as the molybdenum compounds, ditridecylamine salt of molybdic acid was used in such an amount that the content of molybdenum was 1,000 ppm by weight, and molybdenum oxy-sulfide N,N-dipentadecyldithiocarbamate was used in such an amount that the content of molybdenum was 500 ppm by weight.

The friction coefficients of the prepared lubricating oil composition immediately after the preparation and after the oxidation test could not be measured because the obtained solution was rather in a suspended condition. In this lubricating oil composition, molybdenum dithiocarbamate was not completely dissolved. The amount of the precipitates increased after the composition was left standing at −10° C.

COMPARATIVE EXAMPLE 8

A lubricating oil composition was prepared in accordance with the same formulation as that in Example 1 except that, as the molybdenum compounds, ditridecylamine salt of molybdic acid was used in such an amount that the content of molybdenum was 1,000 ppm by weight, and molybdemum oxy-sulfide N,N-dipentyldithiocarbamate was used in such an amount that the content of molybdenum was 500 ppm by weight.

The friction coefficients of the prepared lubricating oil composition immediately after the preparation and after the oxidation test could not be measured because the obtained solution was rather in a suspended condition. In this lubricating oil composition, molybdenum dithiocarbamate was not completely dissolved. The amount of the precipitates increased after the composition was left standing at −10° C.

The formulations and the results of the evaluation in Comparative Examples 1 to 8 are shown together in Table 2.

TABLE 2-1

| Comparative Example | 1 | 2 | 3 | 4 |
|---|---|---|---|---|
| base oil | mineral oil | mineral oil | mineral oil | mineral oil |
| metallic detergent (% by wt.) calcium sulfonate | 2.0 | 2.0 | 2.0 | 2.0 |
| ashless dispersant (% by wt.) | 5.0 | 5.0 | 5.0 | 5.0 |

TABLE 2-1-continued

| | | | | |
|---|---|---|---|---|
| succinimide | | | | |
| antioxidant (% by weight) | 1.0 | 1.0 | 1.0 | 1.0 |
| hindered phenol | | | | |
| antiwear agent (% by wt.) | 1.0 | 1.0 | 1.0 | 1.0 |
| zinc dithiophosphate | | | | |
| viscosity index improver (% by wt.) | 5.0 | 5.0 | 5.0 | 5.0 |
| polyalkyl methacrylate | | | | |
| Mo derived from amine salt of molybdic acid (ppm) | 1,000 | — | 150 | 1,000 |
| R = tridecyl group | | | | |
| Mo derived from molybdenum dithiocarbamate (ppm) | — | 500 | 500 | 100 |
| $R^1$~$R^4$ = octyl group | | | | |
| Mo derived from molybdenum dithiocarbamate (ppm) | — | — | — | — |
| $R^1$~$R^4$ = | | | | |
| glycerol ester of fatty acid (% by wt.) | — | — | — | — |
| friction coefficient of fresh oil | 0.18 | 0.11 | 0.11 | 0.11 |
| friction coefficient after oxidation test | 0.20 | 0.15 | 0.17 | 0.17 |
| formation of precipitates | none | none | none | none |

TABLE 2-2

| Comparative Example | 5 | 6 | 7 | 8 |
|---|---|---|---|---|
| base oil | mineral oil | mineral oil | mineral oil | mineral oil |
| metallic detergent (% by wt.) | 2.0 | 2.0 | 2.0 | 2.0 |
| calcium sulfonate | | | | |
| ashless dispersant (% by wt.) | 5.0 | 5.0 | 5.0 | 5.0 |
| succinimide | | | | |
| antioxidant (% by weight) | 1.0 | 1.0 | 1.0 | 1.0 |
| hindered phenol | | | | |
| antiwear agent (% by wt.) | 1.0 | 1.0 | 1.0 | 1.0 |
| zinc dithiophosphate | | | | |
| viscosity index improver (% by wt.) | 5.0 | 5.0 | 5.0 | 5.0 |
| polyalyl methacrylate | | | | |
| Mo derived from amine salt of molybdic acid (ppm) | 1,000 | — | 1.000 | 1,000 |
| R = tridecyl group | | | | |
| Mo derived from molybdenum dithiocarbamate (ppm) | 800 | — | — | — |
| $R^1$~$R^4$ = octyl group | | | | |
| Mo derived from molybdenum dithiocarbamate (ppm) | — | — | 500 pentadecyl group | 500 pentyl group |
| $R^1$~$R^4$ = | | | | |
| glycerol ester of fatty acid (% by wt.) | — | 10 | — | — |
| friction coefficient of fresh oil | 0.08 | 0.20 | —[1)] | —[1)] |
| friction coefficient after oxidation test | 0.08 | 0.20 | —[1)] | —[1)] |
| formation of precipitates | formed | none | formed[2)] | formed[2)] |

[1)]measurement not possible because the solution was in a suspended condition
[2)]molybdenum dithiocarbamate not completely dissolved The lubricating oil composition obtained in Comparative Example 1 in which the amine salt of molybdic acid alone was used and a molybdenum dithiocarbamate was not used had a large friction coefficient and was inferior in the low friction property. The lubricating oil composition obtained in Comparative Example 2 in which the molybdenum dithiocarbamate alone was used and an amine salt of molybdic acid was not used, the lubricating oil composition obtained in Comparative Example 3 in which the content of molybdenum derived from the amine salt of molybdic acid was 150 ppm by weight, and the lubricating oil composition obtained in Comparative Example 4 in which the content of molybdenum derived from the molybdenum dithiocarbamate was 100 ppm by weight showed an increase in the friction coefficients by the oxidation test though the friction coefficients immediately after the preparation were small. These lubricating oil compositions were inferior in the oxidation stability. The lubricating oil composition obtained in Comparative Example 5 in which the content of molybdenmn derived from the molybdenum dithiocarbamate was 800 ppm by weight showed the formation of precipitates after being left standing at −10° C. and was inferior in the low temperature stability. The lubricating oil composition obtained in Comparative Example 6 in which an ester of fatty acid was used in place of a molybdenum compound showed a large friction coefficient and was inferior in the low friction property. The lubricating oil composition obtained in Comparative Example 7 in which the molybdenum dithiocarbamate containing a hydrocarbon group having 15 carbon atoms was used and the lubricating oil composition obtained in Comparative Example 8 in which the molybdenum dithiocarbamate containing a hydrocarbon group having 5 carbon atoms did not allow complete solution of the molybdenum dithiocarbamate and showed increase in the amounts of precipitates after being left standing at −10° C.

What is claimed is:

1. A lubricating oil composition comprising:

(A) a lubricating base oil having a kinematic viscosity of 3 to 20 $mm^2/s$ at 100° C., (B) an amine salt of molybdic acid represented by the following formula (1):

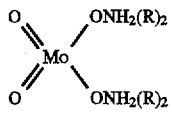

(1)

wherein R represents a hydrocarbon group having 6 to 15 carbon atoms, and (C) at least one molybdenum compound selected from the group consisting of (i) a molybdenum dithiocarbamate represented by the following formula (2):

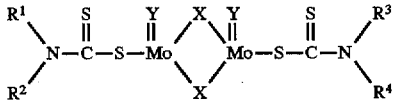

(2)

wherein $R^1$, $R^2$, $R^3$ and $R^4$ each represent a hydrocarbon group having 6 to 15 carbon atoms, and X and Y each represent S or O; and (ii) a molybdenum dithiophosphate represented by the following formula (3):

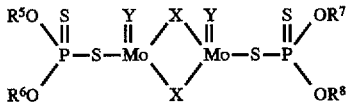

(3)

wherein $R^5$, $R^6$, $R^7$, and $R^8$ each represent a hydrocarbon group having 6 to 15 carbon atoms, and X and Y each represent S or O, wherein the content of molybdenum from the amine salt of molybdic acid is 200 to 2,500 ppm by weight, the content of molybdenum from the molybdenum dithiocarbamate and/or the molybdenum dithiophosphate is 200 to 700 ppm by weight, and the total content of molybdenum is 400 to 3,200 ppm by weight.

2. The lubricating oil composition according to claim 1, wherein the lubricating base oil is a hydrogenated oil or a lubricating oil obtained by isomerization of wax, containing 3% by weight or less of aromatic fractions and no more than 50 ppm by weight sulfur.

3. The lubricating oil composition according to claim 1, wherein the content of molybdenum from the amine salt of molybdic acid is 400 to 2,000 ppm by weight and the total content of molybdenum is 600 to 2,700 ppm by weight.

4. The lubricating oil composition according to claim 1, wherein $R^1$, $R^2$, $R^3$, and $R^4$ in the formula (2) each represent a hydrocarbon group having 8 to 13 carbon atoms, and $R^5$, $R^6$, $R^7$, and $R^8$ in the formula (3) each represent a hydrocarbon group having 8 to 13 carbon atoms.

5. The lubricating oil composition according to claim 1, wherein $R^1$, $R^2$, $R^3$, and $R^4$ in the formula (2) each represent an alkyl, an alkenyl, a cycloalkyl, an aryl, an alkylaryl or an arylalkyl group, and $R^5$, $R^6$, $R^7$, and $R^8$ in the formula (3) each represent an alkyl, an alkenyl, a cycloalkyl, an aryl, an alkylaryl or an arylalkyl group.

6. The lubricating oil composition according to claim 3, wherein $R^1$, $R^2$, $R^3$, and $R^4$ in the formula (2) each represent a hydrocarbon group having 8 to 13 carbon atoms, and $R^5$, $R^6$, $R^7$, and $R^8$ in the formula (3) each represent a hydrocarbon group having 8 to 13 carbon atoms.

7. The lubricating oil composition according to claim 4, wherein $R^1$, $R^2$, $R^3$, and $R^4$ in the formula (2) each represent an alkyl, an alkenyl, a cycloalkyl, an aryl, an alkylaryl or an arylalkyl group, and $R^5$, $R^6$, $R^7$, and $R^8$ in the formula (3) each represent an alkyl, an alkenyl, a cycloalkyl, an aryl, an alkylaryl or an arylalkyl group.

8. The lubricating oil composition according to claim 6, wherein in the formula (2), $R^1$, $R^2$, $R^3$, and $R^4$ each represent an alkyl, an alkenyl, a cycloalkyl, an aryl, an alkylaryl or an arylalkyl group, X represents O, and Y represents S; and in the formula (3), $R^5$, $R^6$, $R^7$, and $R^8$ each represent an alkyl, an alkenyl, a cycloalkyl, an aryl, an alkylaryl or an arylalkyl group, X represents O, and Y represents S.

9. The lubricating oil composition according to claim 4, wherein R in the formula (1) represents a hydrocarbon group having 10 to 13 carbon atoms.

10. The lubricating oil composition according to claim 6, wherein R in the formula (1) represents a hydrocarbon group having 10 to 13 carbon atoms.

11. The lubricating oil composition according to claim 9, wherein R in the formula (1) represents an alkyl, an alkenyl, a cycloalkyl, an aryl, an alkylaryl or an arylalkyl group.

12. The lubricating oil composition according to claim 10, wherein R in the formula (1) represents an alkyl, an alkenyl, a cycloalkyl, an aryl, an alkylaryl or an arylalkyl group.

13. The lubricating oil composition according to claim 7, wherein R in the formula (1) represents an alkyl, an alkenyl, a cycloalkyl, an aryl, an alkylaryl or an arylalkyl group having 10 to 13 carbon atoms.

14. The lubricating oil composition according to claim 8, wherein R in the formula (1) represents an alkyl, an alkenyl, a cycloalkyl, an aryl, an alkylaryl or an arylalkyl group having 10 to 13 carbon atoms.

15. A lubricating oil composition comprising:

(A) a lubricating base oil having a kinematic viscosity of 3 to 20 $mm^2/s$ at 100° C., (B) an amine salt of molybdic acid represented by the following formula (1):

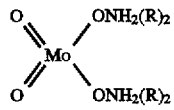

(1)

wherein R represents a hydrocarbon group having 6 to 15 carbon atoms, (C) is at least one molybdenum compound selected from the group consisting of (i) a molybdenum dithiocarbamate represented by the following formula (2):

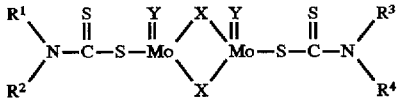

(2)

wherein $R^1$, $R^2$, $R^3$, and $R^4$ each represent a hydrocarbon group having 6 to 15 carbon atoms, and X and Y each represent S or O and (ii) a molybdenum dithiophosphate represented by the following formula (3):

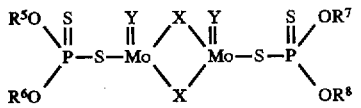

(3)

wherein $R^5$, $R^6$, $R^7$, and $R^8$ each represent a hydrocarbon group having 6 to 15 carbon atoms, and X and Y each represent S or O, wherein the content of molybdenum from the amine salt of molybdic acid is 200 to 2500 ppm by weight, the content of molybdenum from the molybdenum dithiocarbamate and/or the molybdenum dithiophosphate is 200 to 700 ppm by weight, the total content of molybdenum is 400 to 3,200 ppm by weight, and (D) at least one additive selected from the group consisting of a metallic detergent, an ashless dispersant, an antioxidant, an antiwear agent and a viscosity index improver.

16. The lubricating oil composition according to claim 15, wherein the content of molybdenum from the amine salt of molybdic acid is 400 to 2,000 ppm by weight and the total content of molybdenum is 600 to 2,700 ppm by weight.

17. The lubricating oil composition according to claim 16, wherein R in the formula (1) represents an alkyl, an alkenyl, a cycloalkyl, an aryl, an alkylaryl or an arylalkyl group having 10 to 13 carbon atoms; $R^1$, $R^2$, $R^3$, and $R^4$ in the formula (2) each represent an alkyl, an alkenyl, a cycloalkyl, an aryl, an alkylaryl or an arylalkyl group having 10 to 13 carbon atoms, and $R^5$, $R^6$, $R^7$, and $R^8$ in the formula (3) each represent an alkyl, an alkenyl, a cycloalkyl, an aryl, an alkylaryl or an arylalkyl group having 10 to 13 carbon atoms.

18. The lubricating oil composition claimed in claim 1, wherein the lubricating oil is selected from the group consisting of 60 neutral oil, 100 neutral oil, 150 neutral oil, 300 neutral oil, 500 neutral oil, bright stock, poly-α-olefin oligomers, polybutenes, alkylbenzenes, polyol esters, polyglycol esters, esters of dibasic acids, esters of phosphoric acid and silicone oils.

19. The lubricating oil composition claimed in claim 15, wherein the at least one additive is selected from the group consisting of (i) 0.1 to 5% by weight of a metallic detergent selected from the group consisting of a calcium salicylate, a magnesium salicylate, a calcium sulfonate, a magnesium sulfonate, a barium sulfonate, a calcium phenate and a barium phenate, (ii) 0.05 to 5% by weight of an antiwear agent which is a metal salt of a compound selected from the group consisting of thiophosphoric acid, a sulfur compound, an ester of phosphoric acid and an ester of phosphorous acid, (iii) 0.5 to 7% by weight of ashless dispersant selected from the group consisting of a succinimide, a succinamide, a benzylamine and an ester, (iv) 0.05 to 4% by weight of an antioxidant selected from the group consisting of an alkylated diphenylamine, a phenyl-α-naphthylamine, an alkylated α-naphthylamine, 2,6-di-t-butyl-4-methylphenol and 4,4'-methylene bis (2,6-di-t-butyl phenol), and (v) 0.5 to 35% by weight of a viscosity index improver selected from the group consisting of a polymethacrylate, a polyisobutylene, an ethylene-propylene copolymer and a hydrogenated styrene-butadiene copolymer.

* * * * *